US009907993B2

(12) United States Patent
Penney

(10) Patent No.: US 9,907,993 B2
(45) Date of Patent: Mar. 6, 2018

(54) ELASTOMERIC HAND GRIPS

(71) Applicant: Gregory Alan Penney, Benicia, CA (US)

(72) Inventor: Gregory Alan Penney, Benicia, CA (US)

( * ) Notice: Subject to any disclaimer, the term of this patent is extended or adjusted under 35 U.S.C. 154(b) by 0 days.

(21) Appl. No.: 14/842,830

(22) Filed: Sep. 1, 2015

(65) Prior Publication Data

US 2016/0158594 A1 Jun. 9, 2016

Related U.S. Application Data

(60) Provisional application No. 62/044,456, filed on Sep. 2, 2014.

(51) Int. Cl.

| | |
|---|---|
| ***A63B 23/16*** | (2006.01) |
| ***A63B 21/072*** | (2006.01) |
| ***A63B 21/075*** | (2006.01) |
| ***A63B 21/00*** | (2006.01) |
| *A63B 23/12* | (2006.01) |

(52) U.S. Cl.

CPC ..... *A63B 21/4035* (2015.10); *A63B 21/072* (2013.01); *A63B 21/0724* (2013.01); *A63B 21/0726* (2013.01); *A63B 23/1218* (2013.01); *A63B 2209/00* (2013.01)

(58) Field of Classification Search

CPC ..... A63B 21/072; A63B 21/0722; A63B 21/0724; A63B 21/0726; A63B 21/0728; A63B 21/075; A63B 21/4035

USPC ..... 482/108, 139

See application file for complete search history.

(56) References Cited

U.S. PATENT DOCUMENTS

| | | | | | |
|---|---|---|---|---|---|
| 5,135,455 | A * | 8/1992 | King | A63B 21/0726 | 482/105 |
| 5,415,607 | A * | 5/1995 | Carpenter | A63B 21/0728 | 482/106 |
| 5,860,190 | A * | 1/1999 | Cano | A47G 21/02 | 16/422 |
| 6,183,400 | B1 * | 2/2001 | Pope | A63B 21/4019 | 16/422 |
| 6,224,518 | B1 * | 5/2001 | Weiss | A63B 21/078 | 482/104 |
| 7,736,284 | B1 * | 6/2010 | Andrews | A63B 21/072 | 482/108 |
| 8,128,541 | B2 * | 3/2012 | Hartman | A63B 23/16 | 482/122 |
| 8,267,841 | B1 * | 9/2012 | Allison | A63B 21/06 | 482/106 |
| 8,500,609 | B1 * | 8/2013 | Williams | A63C 11/228 | 135/65 |
| 2001/0052710 | A1 * | 12/2001 | Witherell | A63B 21/072 | 294/137 |
| 2008/0305884 | A1 * | 12/2008 | Cameron | A63B 53/14 | 473/300 |
| 2013/0196824 | A1 * | 8/2013 | Ross | A63B 1/005 | 482/40 |
| 2015/0367163 | A1 * | 12/2015 | Moran | A63B 21/075 | 482/108 |

* cited by examiner

*Primary Examiner* — Nyca T Nguyen

(57) ABSTRACT

Disclosed is a tubular elastomeric grip with raised or embossed geometric designs arrayed around its circumference with an axial cut along its length adapted to be removably attached to a cylindrical bar such as those used while participating in fitness activities associated with the gripping of a bar or handle.

16 Claims, 2 Drawing Sheets

ELASTOMERIC HAND GRIPS

CROSS REFERENCE TO RELATED APPLICATIONS

This application claims the benefit of U.S. Provisional Application Ser. No. 62/044,456 filed Sep. 2, 2014, the entire contents of which are hereby incorporated by reference.

BACKGROUND

This disclosure relates to a molded article for use on physical fitness machinery and equipment.

SUMMARY

The grip is used while participating in fitness activities associated with the gripping of a bar or handle. These activities may include, but not limited to, barbell lifts and presses, various gymnastic movements such as pull ups, bar hangs, kettle bell swings, sled pushing and pulling.

DETAILED DESCRIPTION

The item is a molded article for use on physical fitness machinery and equipment.

They may also be used in a similar capacity as grips for bicycles, motorcycles, scooters which may require gripping a bar.

Functional uses in occupational therapy for patients requiring grip assistance in everyday activities.

The product is unique in its design in that it is functional to a number of applications. The design allows it to be quickly portable while at the same time displaying features of a more permanent grip.

The attached drawings provide details of the design and one of the intended uses and their means of attachment.

Channels are designed within the grip to allow straps for securing to grips to the bar.

Figure 1:
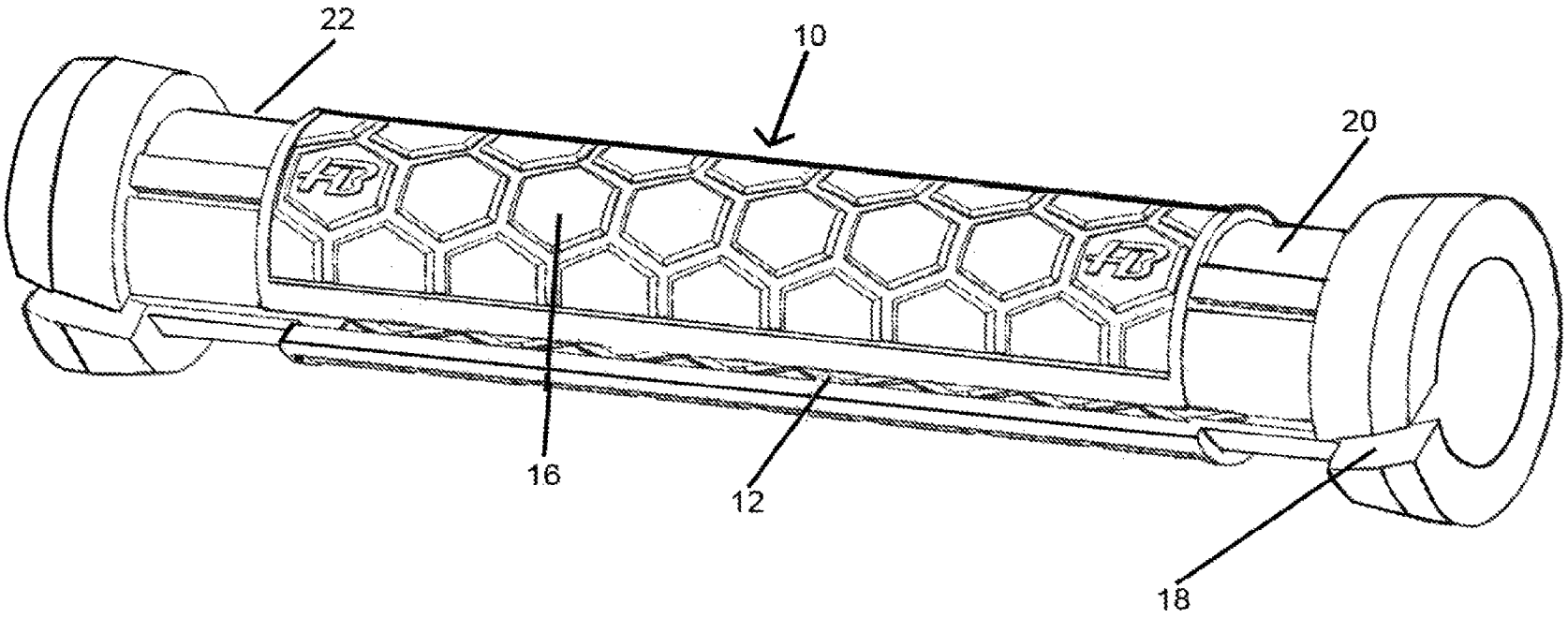
FIG. 1 is a perspective view of the grip of the invention.

The following refers to FIG. 1. The product itself is designed to be used as a grip 10 and would be slightly longer than the width of a hand. These lengths could vary depending on the intended user. A typical length would be approximately 7" with a +−5 inch circumference sufficient to encircle the bar which is placed around. The inner diameter would have a similar variance with a starting inner diameter of 1 inch Typical pull up bars have slightly larger diameters. The material of the grips would allow for adapting to this change.

A tubular elastomeric grip is disclosed with raised or embossed geometric designs arrayed around its circumference with an axial cut along its length adapted to be removably attached to a cylindrical bar such as those used while participating in fitness activities associated with the gripping of a bar or handle. Further, a grip is disclosed comprising a tubular body having an outer surface with circumferential grooves spaced axially inward from the ends of said tubular body and an opening extending axially along the entire length of said tubular body; and raised geometric patterns distributed radically and axially on the inner and/or outer surface. In a preferred embodiment, both inner and outer surfaces of the grip may be textured, a unique feature compared to any other grips available. The inner diameter would aid in the grip staying in place on the piece of equipment. The hexagon shapes 12 on the interior would be in direct contact with the bars and could be a variety of patterns. (Pattern examples would be hexagon, honeycomb, diamond, herringbone, square, etc.) This inner diameter pattern is unique to grips.

The outer diameter 14 which comes in contact with the users hands could vary in some of the patterns referenced above. The hexagon design 16 is the one used in the attached diagram.

The following is a list of the types of suitable equipment for use:

Pull up bars: Brands such as Rogue Fitness, Pro Source, Iron Gym, Black Mountain, Ultimate Body, Go Fit, Champion, P90X, etc.

Kettlebells: Ader, Dragon Door, Peform Better, Lifeline, Kettlebell Concepts, Valeo, Iron Masters, Kettlestacks, Hampton, etc.

Barbells: Ivanko, Rogue, Cemco, Leiko, Weider, Hampton, etc.

The grips themselves can be made out of many different types of materials. Examples would include rubber, foam, plastic, cork, polyurethane, gel, etc. Preferred is one of the many thermoplastics or elastomers. Within these varying materials, there are also varying styles and designs. The diagrams included use a hexagon design, but the utility of the grips is the same regardless of the patterns.

Figure 2:
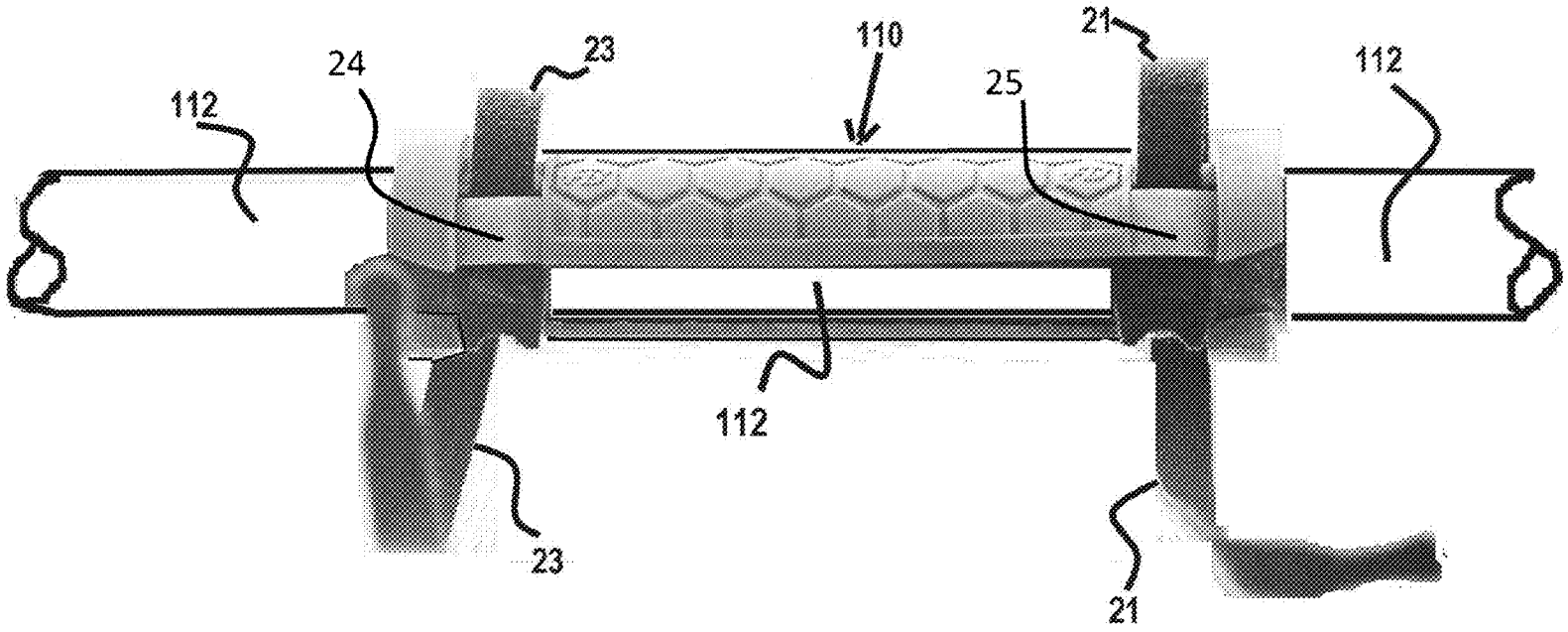
FIG. 2 is a view of the grips installed on an exercise bar.

The grip has an ergonomic design that mirrors the length of a user's hands and fingers. It also has a split center 18 to allow for the hands to be in contact with both the grip and the bar it is placed on. FIG. 2 shows a grip 110 affixed to an exercise bar 112 with Velcro straps 21, 23 wrapped circumferentially around each end in a groove 20, 22 molded into each lateral end of the grip forming channels 26, 27 as best shown in FIG. 1. FIG. 2 shows the straps 21, 23 inserted into the channels 26, 27 formed by grooves 20, 22 and threaded through axially disposed openings 24, 25 within each of the first and second circumferential grooves 20,22 to securely hold the straps 21, 23 in place in the grooves. Velcro™ (trademark of Velcro Industries, Curacao) is a brand name for a well-known type of hook-and-loop fasteners or hook-and-pile fasteners typically having two lineal fabrics. The first component features tiny hooks; the second features loops. When the two components are pressed together, the hooks catch in the loops and the two pieces fasten or bind temporarily during the time that they are pressed together.

Natural and Synthetic Rubber for Making the Grips

Materials useful in manufacturing the article of this invention include natural or synthetic elastomers. Representative of the highly unsaturated polymers which may be employed in the practice of this invention are diene elastomers. Such elastomers will typically possess an iodine number of between about 100 and about 400, although highly unsaturated rubbers having a higher or a lower (i.e., of 50-100) iodine number may also be employed. Illustrative of the diene elastomer which may be utilized are polymers based on conjugated dienes such as 1,3-butadiene: 2-methyl-1,3-butadiene: 1,3-pentadiene: 2,3-dimethyl-1,3-butadiene; and the like, as well as copolymers of such conjugated dienes with monomers such as styrene, alpha-methylstyrene, acrylonitrile, methacrylonitrile, methyl acrylate, ethyl acrylate, methyl methacrylate, ethyl methacrylate, vinyl acetate and the like. Preferred highly unsaturated rubbers include natural rubber, cis-polyisoprene, polybutadiene, poly(styrene-butadiene), polychloroprene and poly(acrylonitrile-butadiene). Moreover, mixtures of two or more highly unsaturated rubbers may be employed. Also, mixtures of the highly unsaturated rubbers with elastomers having lesser unsaturation (iodine number between 10-100) such as EPDM, EPR, butyl or halogenated butyl rubbers are also very useful in articles of the invention.

The curative system employed when blends of highly unsaturated and lesser unsaturation rubbers are utilized is critical to good physical properties. This preferred system comprises a sulfur containing cure component selected from sulfur or a sulfur donor compound, at least one sulfur cure accelerator and at least one organic peroxide curative.

The sulfur donor compounds which may be employed in conjunction with or in the alternative to sulfur are well known to those skilled in the art of rubber compounding. Illustrative of such sulfur donor compounds are 2-(4-morpholinyldithio)benzothiazole, tetramethylthiuram disulfide, tetraethylthiuram disulfide, dipentamethylene thiuram hexasulfide, N,N'-caprolactam disulfide and the like.

The sulfur cure accelerators which may be employed include thioureas, such as N,N'-dibutylthiourea, 2-mercaptoimidazoline, tetramethylthiourea and the like; guanidine derivatives, such as N,N'-diphenylguanidine and the like; xanthates, such as zinc dibutylxanthate and the like; dithiocarbamates, such as zinc dimethyldithiocarbamate, zinc diethyldithiocarbamate, zinc dibutyldithiocarbamate, sodium diethyldithiocarbamate, and the like; thiuramsulfides, such as dipentamethylenethiuram disulfide, dipentamethylenethiuram hexasulfide, tetrabutylthiuram monosulfide, tetramethylthiuram monosulfide, tetraethylthiuram monosulfide, tetraethylthiuram disulfide and the like; heterocyclics, such as mercaptobenzimidazole, mercaptobenzthiazole, 2,2'-dibenzothiazyl disulfide, zinc 2-mercaptobenzothiazole and the like: and sulfenamides, such as N-oxydiethylene-2-benzothiazolesulfenamide, N-t-butylbenzothiazylsulfenamide, N-cyclohexyl2-benzothiazylsulfenamide, N,N-diisopropyl-2-benzothiazylsulfenamide and the like. Moreover, mixtures of two or more sulfur cure accelerators may be employed in the curing agent. The preferred accelerators are thiazoles and sulfenamides, with sulfenamides being particularly preferred.

The peroxides which may be employed in this invention have an activation temperature which is below the decomposition temperature of the rubbers employed. Illustrative of such peroxides are benzoyl peroxide, dibenzoyl peroxide, 1,3-bis(t-butylperoxyisopropyl)benzene, diacetyl peroxide, butyl 4,4-bis(t-butylperoxy)valerate, p-chlorobenzoyl peroxide, cumene hydroperoxide, t-butyl cumyl peroxide, t-butyl perbenzoate, di-t-butyl peroxide, dicumyl peroxide, 2,5-dimethyl-2,5-di-t-butylperoxyhexane, 2,5-dimethyl-2,5-di-t-butyl-peroxyhex-3-yne, 4-methyl-2,2-di-t-butylperoxypentane and the like. Mixtures of two or more peroxides may also be employed. The preferred peroxides are dicumyl peroxide and 2,5-dimethyl-2,5-di-t-butylperoxyhexane.

The highly unsaturated polymers to be protected may be formulated in conventional manner with the many usual compounding ingredients, for example, vulcanizing agents, accelerators, activators, retarders, antiozonants, antioxidants, plasticizing oils and softeners, fillers, reinforcing pigments and carbon blacks.

Silicone Rubber for Making the Grips

There are also many special grades and forms of silicone rubber, including: steam resistant, metal detectable, high tear strength, extreme high temperature, extreme low temperature, electrically conductive, chemical/oil/acid/gas resistant, low smoke emitting, and flame-retardant. A variety of fillers can be used in silicone rubber, although most are non-reinforcing and lower the tensile strength.

Silicone rubber is available in a range or hardness levels, expressed as Shore A or IRHD between 10 and 100, the higher number being the harder compound. It is also available in virtually any colour and can be colour matched.

Injection molding of liquid silicone rubber (LSR) is a process to produce pliable, durable parts in high volume.

Liquid silicone rubber is a high purity platinum cured silicone with low compression set, great stability and ability to resist extreme temperatures of heat and cold ideally suitable for production of parts, where high quality is a must. Due to the thermosetting nature of the material, liquid silicone injection molding requires special treatment, such as intensive distributive mixing, while maintaining the material at a low temperature before it is pushed into the heated cavity and vulcanized.

Chemically, silicone rubber is a family of thermoset elastomers that have a backbone of alternating silicon and oxygen atoms and methyl or vinyl side groups. Silicone rubbers constitute about 30% of the silicone family, making them the largest group of that family. Silicone rubbers maintain their mechanical properties over a wide range of temperatures and the presence of methyl-groups in silicone rubbers makes these materials extremely hydrophobic.

Liquid silicone rubber are products that require high precision or smooth surfaces. Silicone rubber or other rubbers or plastics may be overmolded onto the magnetic strips.

Plastic Materials Useful for Making the Grips With Magnetic Strips

Possible Thermoplastic Polymers which have utility are listed with the Tm or Tg sometimes listed after it.

| | | |
|---|---|---|
| Acrylonitrile butadiene styrene (ABS) | | |
| Acrylic (PMMA) | 130-140° C. | |
| Celluloid | | |
| Cellulose acetate | | |
| Cyclic Olefin Copolymer (COC) | | |
| Ethylene-Vinyl Acetate (EVA) | | |
| Ethylene vinyl alcohol (EVOH) | | |
| Fluoroplastics (PTFE, alongside with FEP, PFA, CTFE, ECTFE, ETFE) | | |
| Ionomers | | |
| Kydex, a trademarked acrylic/PVC alloy | | |
| Liquid Crystal Polymer (LCP) | | |
| Polyoxyme thylene (POM or Acetal) | 166° C. | |
| Polyacrylates (Acrylic) | | |
| Polyacrylonitrile (PAN or Acrylonitrile) | | |
| Polyamide (PA or Nylon) | | |
| Polyamide-imide (PAI) | | |
| Polyaryletherketone (PAEK or Ketone) | | |
| Polybutadiene (PBD) | | |
| Polybutylene (PB) | | |
| Polybutylene terephthalate (PBT) | 160° C. | 40° C. |
| Polycaprolactone (PCL) | 62° C. | |
| Polychlorotrifluoroethylene (PCTFE) | | |
| Polyethylene terephthalate (PET) | 260° C. | 75° C. |
| Polycyclohexylene dimethylene terephthalate (PCT) | | |
| Polycarbonate (PC) | 267° C. | |
| Polyhydroxyalkanoates (PHAs) | 1451 | |
| Polyketone (PK) | | |
| Polyester | 260 C. | 75 C. |
| Polyethylene (PE) | 105-130° C. | −127° C. |

-continued

| | | |
|---|---|---|
| Polyetheretherketone (PEEK) | 343° C. | 143° C. |
| Polyetherketoneketone (PEKK) | | |
| Polyetherimide (PEI) | | |
| Polyethersulfone (PES) - see Polysulfone | | |
| Chlorinated Polyethylene (CPE) | | |
| Polyimide (PI) | | |
| Polylactic acid (PLA) | 50-80° C. | |
| Polymethylpentene (PMP) | | |
| Polyphenylene oxide (PPO) | | |
| Polyphenylene sulfide (PPS) | | |
| Polyphthalamide (PPA) | | |
| Polypropylene (PP) | 160° C. | |
| Polystyrene (PS) | 240° C. | |
| Polysulfone (PSU) | | |
| Polytrimethylene terephthalate (PTT) | | |
| Polyurethane (PU) | | |
| Polyvinyl acetate (PVA) | 32° C. | |
| Polyvinyl chloride (PVC) | 80° C. | |
| Polyvinylidene chloride (PVDC) | 185° C. | 40° C. |
| Styrene-acrylonitrile (SAN) | | |

Some methods of molding thermosets and thermoplastics are:

- Reactive injection molding (used for objects such as milk bottle crates)
- Extrusion molding (used for making pipes, threads of fabric and insulation for electrical cables)
- Compression molding (used to shape most thermosetting plastics)
- Spin casting (used for producing fishing lures and jigs, gaming miniatures, figurines, emblems as well as production and replacement parts)

Broad Listing of Materials for Manufacture of Grips

Suitable materials for the highly flexible compositions with optional additional fillers encompass many types of materials including those that follow. The organic polymers suitable for forming the grips can comprise polyacetals, polyureas, polyurethanes, polyolefins, polyacrylics, polycarbonates, polyalkyds, polystyrenes, polyesters, polyamides, polyaramides, polyamideimides, polyarylates, polyarylsulfones, polyethersulfones, polyphenylene sulfides, polysulfones, polyimides, polyetherimides, polytetrafluoroethylenes, polyetherketones, polyether etherketones, polyether ketone ketones, polybenzoxazoles, polyoxadiazoles, polybenzothiazinophenothiazines, polybenzothiazoles, polypyrazinoquinoxalines, polypyromellitimides, polyquinoxalines, polybenzimidazoles, polyoxindoles, polyoxoisoindolines, polydioxoisoindolines, polytriazines, polypyridazines, polypiperazines, polypyridines, polypiperidines, polytriazoles, polypyrazoles, polycarboranes, polyoxabicyclononanes, polydibenzofurans, polyphthalides, polyacetals, polyanhydrides, polyvinyl ethers, polyvinyl thioethers, polyvinyl alcohols, polyvinyl ketones, polyvinyl halides, polyvinyl nitriles, polyvinyl esters, polysulfonates, polysulfides, polythioesters, polysulfones, polysulfonamides, polyureas, polyphosphazenes, polysilazanes, polyolefins, polysiloxanes, fluoropolymers, polybutadienes, polyisoprenes, urethane acrylates, urethane methacrylates, natural rubber, nitrile rubber, or other synthetic polymers or co-polymers, polyblends that exhibit high flexibility or elastomeric properties, or a combination comprising at least one of the foregoing organic polymers. Exemplary organic polymers are polyurethanes, polyureas, fluoropolymers, urethane acrylates/methacrylates, fluorinated urethanes, fluorinated polyurea, copolymer or polyblends of polyurethane, polyurea or fluoropolymers. It is desirable for the polyurethane, the polyurea, and the fluoropolymers, to be an elastomer. The aforementioned organic polymers listed above can be blended and/or copolymerized with the polyurethane or polyurea if desired. The base elastomers can be fully reacted such as water based polyurethane, fully reacted thermoplastic elastomers such as polyurethane, TPR (Thermoplastic rubber), EPDM rubber, nitrile rubber, chlorinated rubber, butyl rubber, SBR (styrene butadiene) rubber, fluoroelastomer, silicone rubber, natural rubber, etc.

Polyurethanes and Polyurea Elastomers for the Grips

The most preferred elastomer is polyurethane, polyurea and fluoroelastomers. Polyurethane and polyurea are both sometimes referred as polyurethane commercially. In this application, urethane copolymers, urea copolymers are also regarded as polyurethanes.

The isocyanates in the polyurethane elastomers can be aromatic or aliphatic. Useful aromatic diisocyanates can include, for example, 2,4-toluene diisocyanate and 2,6-toluene diisocyanate (each generally referred to as TDI); mixtures of the two TDI isomers; 4,4'-diisocyanatodiphenylmethane (MDI); p-phenylene diisocyanate (PPDI); diphenyl-4,4'-diisocyanate; dibenzyl-4,4'-diisocyanate; stilbene-4,4'-diisocyanate; benzophenone-4,4'-diisocyanate; 1,3- and 1,4-xylene diisocyanates; or the like, or a combination comprising at least one of the foregoing aromatic isocyanates.

Useful aliphatic diisocyanates can include, for example, 1,6-hexamethylene diisocyanate (HDI); 1,3-cyclohexyl diisocyanate; 1,4-cyclohexyl diisocyanate (CHDI); the saturated diphenylmethane diisocyanate known as H(12)MDI; isophorone diisocyanate (IPDI); or the like; or a combination comprising at least one of the foregoing isocyanates.

Other exemplary polyisocyanates include hexamethylene diisocyanate (HDI), 2,2,4- and/or 2,4,4-trimethyl-1,6-hexamethylene diisocyanate, dodecamethylene diisocyanate, 1,4-diisocyanatocyclohexane, 1-isocyanato-3,3,5-trimethy-5-isocyanatomethylcyclohexane (IPDI), 2,4'- and/or 4,4'-diisocyanato-dicyclohexyl methane, 2,4- and/or 4,4'-diisocyanato-diphenyl methane and mixtures of these isomers with their higher homologues which are obtained by the phosgenation of aniline/formaldehyde condensates, 2,4- and/or 2,6-diisocyanatotoluene and any mixtures of these compounds.

In one embodiment, derivatives of these monomeric polyisocyanates can be used. These derivatives include polyisocyanates containing biuret groups as described, for example, in U.S. Pat. No. 3,124,605, U.S. Pat. No. 3,201,372 and DE-OS 1,101,394; polyisocyanates containing isocyanurate groups as described, for example, in U.S. Pat. No. 3,001,973, DE-PS 1,022,789, 1,222,067 and 1,027,394 and DE-OS 1,929,034 and 2,004,048; polyisocyanates containing urethane groups as described, for example, in DE-OS 953,012, BE-PS 752,261 and U.S. Pat. Nos. 3,394,164 and 3,644,457; polyisocyanates containing carbodiimide groups as described in DE-PS 1,092,007, U.S. Pat. No. 3,152,162 and DE-OS 2,504,400, 2,537,685 and 2,552,350; and polyisocyanates containing allophanate groups as described, for example, in GB-PS 994,890, BE-PS 761,626 and NL-OS 7,102,524. In another embodiment, N,N',N"-tris-(6-isocyanatohexyl)-biuret and mixtures thereof with its higher homologues and N,N',N"-tris-(6-isocyanatohexyl)-isocyanurate and mixtures thereof with its higher homologues containing more than one isocyanurate ring can be used.

Examples of suitable polyols are polyester polyols, polycaprolactone polyols, polyether polyols, polyhydroxy polycarbonates, polyhydroxy polyacetals, polyhydroxy polyacrylates, polyhydroxy polyester amides and polyhydroxy polythioethers. Exemplary polyols are polyester polyols, polyether polyols, polyesters derived from lactones (e.g., ϵ-caprolactone or ω-hydroxycaproic acid), or a combination comprising at least one of the foregoing polyols.

Exemplary isocyanate prepolymers are TDI-ether, TDI-ester, TDI-lactone, MDI-ether, MDI-ester, H12MDI-ether, H12MDI-ester and similar prepolymers made from HDI, IPDI and PPDI. The isocyanate prepolymers with low free isocyanate monomers are preferred.

The grip composition also comprises an optional curing agent. Examples of suitable curing agents are aromatic amines that can be used as curing agents are phenylene diamine, 4,4'methylene-bis-(2-chloroaniline), 4,4'methylenedianiline (MDA), 4,4'methylenebis(2,6-diethylaniline), 4,4'methylenebis(2,6-dimethylaniline), 4,4'methylenebis(2-isopropyl-6-methylaniline), 4,4'methylenebis(2ethyl-6-methylaniline), 4,4'methylenebis(2,6-isopropylaniline), 4,4'methylenebis(3-chloro-2,6-diethylaniline) (MCDEA), 1,3-propanediolbis(4-aminobenzoate), diethyltoluenediamine (DETDA), dimethylthiotoluenediamine; or the like; or a combination comprising at least one of the foregoing aromatic amines. Polyaspartic esters may be used. Polyol curatives are polyester polyols, polycaprolactone polyols, polyether polyols, polyhydroxy polycarbonates, polyhydroxy polyacetals, polyhydroxy polyacrylates, polyhydroxy polyester amides and polyhydroxy polythioethers. Exemplary polyols are polyester polyols, polyether polyols, polyesters derived from lactones (e.g., ϵ-caprolactone or ω-hydroxycaproic acid), or a combination comprising at least one of the foregoing polyols. Imines are useful curatives, including aldimines, ketimines, and multifunctional imines. In addition to the above, curing agents that can produce elastomeric polymers with the isocyanate-terminated prepolymers or polyisocyanates are suitable. Additional examples of other suitable curing agents are listed in patent application Ser. No. 11/136,827, filed May 24, 2005, which is incorporated herein by reference.

Atmospheric moisture may serve to cure solely or may catalyze the reaction between the polyurethane and the curing agent. This is referred to as moisture cure. For aqueous coatings, polyurethane dispersions can be used with or without curing agents. The crosslinking of aqueous polyurethane dispersions may be accomplished by the use of isocyanates, epoxy, aziridines, carbodiimides, and other functional materials.

Other additives useful in the grip compositions include leveling agents, adhesion promoters, coupling agents, defoamers, hydrolysis stabilizers, UV stabilizers, pigments, dispersants, curing accelerators, diluents, or combinations thereof.

The fillers that may be used with the base polymer to make the grip include, but are not limited to, the following list:

silicates (such as talc, clays, (montmorillonite) feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, aluminum trihydrate, metal oxides (such as calcium oxide (lime), aluminum oxide, titanium dioxide, iron oxide, tin oxide) and metal sulfites, metal powders, metal flakes, metal fibers, milled metal fibers, metal nitrides, graphite, carbon nanotubes, carbon fibers and milled carbon fibers, silica (such as quartz, glass beads, glass bubbles and glass fibers), metal-coated glass spheres, metal-coated hollow spheres, buckyballs, electroactive polymers, antimony-doped tin oxide, carbon blacks, coke, micro-balloons, and oxides, borides, carbides, nitrides and silicas from the group of compounds containing boron, aluminum, silicon, titanium, tungsten, and zirconium compounds.

Examples of organic based fillers can be used include thermoplastic powdery material such as polycarbonate, polyetherimide, polyester, polyethylene, polysulfone, polystyrene, acrylonitrile-butadiene-styrene block copolymer, Teflon, fluoropolymers, polypropylene, acetal polymers, polyvinyl chloride, polyurethanes, polyureas, nylon and combinations thereof. In general, some useful thermoplastic polymers are those having a high melting temperature or good heat resistance properties. There are several ways to form a thermoplastic abrasive particle known in the art.

The filler content in the grip, based on the total solid weight, can range from 10% by weight to 90%, depending on the interaction of the fillers and the base elastomers. Preferred is 20% to 80% by weight and more preferred is 30% to 70% by weight.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A grip comprising:

a) a tubular body of flexible organic polymers having an inner and an outer surface with a first and second circumferential groove each spaced axially inward from the ends of said tubular body forming channels in the tubular body, and an axial cut through the tubular body extending axially along the entire length of said tubular body;

b) raised or embossed geometric designs distributed radially and axially on at least one of the inner and the outer surface; and c) a strap exerting pressure radially inward positioned in each of the first and second circumferential grooves.

2. The grip according to claim 1 wherein the strap is a flexible and inextensible strap exerting pressure radially inward positioned in the first and second circumferential grooves.

3. The grip according to claim 2 wherein said strap is a circumferentially disposed clamping device which is removably positioned in said first and second circumferential grooves.

4. The grip according to claim 3 wherein the strap is adapted to exert a variable amount of inward radial pressure by manually decreasing the circumferential diameter of said strap.

5. The grip according to claim 4 wherein the strap is a hook-and-loop fastener strap adapted to exert a variable amount of inward radial pressure by manually decreasing the circumferential diameter of said strap.

6. The grip according to claim 4 wherein the circumferentially disposed strap is a hook-and-loop fastener adjustable for maintaining a predetermined circumferential diameter.

7. The grip according to claim 4 wherein the strap has one side with hooks and the other side with loops adapted to interlock and hold the strap at a predetermined circumference which exerts the required pressure radially inward to hold said grip at a predetermined circumferential dimension.

8. The grip according to claim 1 wherein said flexible organic polymers are selected from the group consisting of natural rubber, cis-polyisoprene, nitrile rubber, polyurethane, polyurea, fluoroelastomers, polybutadiene, poly(styrene-butadiene), polychloroprene and poly(acrylonitrile-butadiene, polyacetals, polyolefins, polyacrylics, polycarbonates, polyalkyds, polystyrenes, polyesters, polyamides, polyaramides, polyamideimides, polyarylates, polyarylsulfones, polyethersulfones, polyphenylene sulfides, polysulfones, polyimides, polyetherimides, polytetrafluoroethylenes, polyetherketones, polyether etherketones, polyether ketone ketones, polybenzoxazoles, polyoxadiazoles, polybenzothiazinophenothiazines, polybenzothiazoles, polypyrazinoquinoxalines, polypyromellitimides, polyquinoxalines, polybenzimidazoles, polyoxindoles, polyoxoisoindolines, polydioxoisoindolines, polytriazines, polypyridazines, polypiperazines, polypyridines, polypiperidines, polytriazoles, polypyrazoles, polycarboranes, polyoxabicyclononanes, polydibenzofurans, polyphthalides, polyacetals, polyanhydrides, polyvinyl ethers, polyvinyl thioethers, polyvinyl alcohols, polyvinyl ketones, polyvinyl halides, polyvinyl nitriles, polyvinyl esters, polysulfonates, polysulfides, polythioesters, polysulfones, polysulfonamides, polyureas, polyphosphazenes, polysilazanes, polyolefins, polysiloxanes, urethane acrylates, urethane methacrylates, water based polyurethane, fully reacted thermoplastic elastomers, polyurethane, TPR (Thermoplastic rubber), EPDM rubber, chlorinated rubber, butyl rubber and mixtures of one or more of the foregoing.

9. The grip according to claim 8 wherein said flexible organic polymers further comprise fillers selected from the group consisting of talc, clays, montmorillonite, feldspar, mica, calcium silicate, calcium metasilicate, sodium aluminosilicate, sodium silicate, calcium sulfate, barium sulfate, sodium sulfate, aluminum sodium sulfate, aluminum sulfate, gypsum, aluminum trihydrate, calcium oxide, aluminum oxide, titanium dioxide, iron oxide, tin oxide, metal sulfites, metal powders, metal flakes, metal fibers, milled metal fibers, metal nitrides, graphite, carbon nanotubes, carbon fibers, silica, quartz, metal-coated glass spheres, carbon blacks, coke, micro-balloons, and oxides, borides, carbides, nitrides and silicas of aluminum, silicon, titanium, tungsten, and zirconium compounds.

10. The grip according to claim 9 wherein said filler content in the grip based on the total solid weight is between 10% by weight to 90% by weight of the total solid weight.

11. The grip according to claim 1 wherein said geometric designs are formed in the outer surface and are selected from the group consisting of hexagon, honeycomb, diamond, herringbone and square shapes.

12. The grip according to claim 11 wherein the raised geometric designs are raised and extend axially and radially around a majority of said outer surface.

13. The grip according to claim 2 wherein said strap is a hook and loop fastener threaded through an axially disposed opening extending axially within each of said first and second circumferential grooves.

14. The grip according to claim 1 further comprising the inner surface of said tubular body having geometric designs distributed radially and axially on the inner surface.

15. The grip according to claim 14 wherein said geometric designs distributed radially and axially on the inner surface are recessed geometric patterns formed in the inner surface extending below the inner surface to form geometric shapes selected from the group consisting of hexagon, honeycomb, diamond, herringbone and square shapes.

16. A method of using a grip having a tubular body of flexible organic polymers having an inner surface and an outer surface with textured patterns embossed on the outer surface and inner surface and a first and second circumferential groove each spaced axially inward from the ends of said tubular body and an axial cut through the tubular body extending axially along the entire length of said tubular body comprising:

attaching said grip to an exercise bar to position the exercise bar axially inside said tubular body;

positioning circumferentially disposed straps in said first and second circumferential groove; and exerting an inward radial pressure by manually decreasing the circumferential diameter of the straps to compressively engage the textured patterns embossed on the inner surface of the tubular body with the exercise bar and limiting the rotation of said tubular body around the exercise bar.

* * * * *